United States Patent [19]

Furr

[11] Patent Number: 4,579,341

[45] Date of Patent: Apr. 1, 1986

[54] SHOOTING GUIDE FOR BASKETBALL PLAYER

[76] Inventor: Guy H. Furr, Rte. #2, Box 158, Murray, Ky. 42071

[21] Appl. No.: 773,884

[22] Filed: Sep. 9, 1985

[51] Int. Cl.[4] ..... A63B 69/00

[52] U.S. Cl. ..... 273/1.5 A; 273/54 B

[58] Field of Search ..... 273/1.5 A, 54 B, 188 R, 273/189 R

[56] References Cited

U.S. PATENT DOCUMENTS

| | | | |
|---|---|---|---|
| 1,591,523 | 7/1926 | Fuller | 273/188 R |
| 2,690,911 | 10/1954 | Newgren | 273/189 R |
| 3,000,633 | 9/1961 | Bonovich | 273/188 R X |
| 3,820,783 | 6/1974 | Caveness | 273/1.5 A |
| 4,383,685 | 5/1983 | Bishop | 273/1.5 A |

*Primary Examiner*—Paul E. Shapiro

*Attorney, Agent, or Firm*—Harrington A. Lackey

[57] ABSTRACT

A shooting guide for a basketball player including a body harness for fitting about the torso of the player, an elongated transverse support member fixed to the back of the body harness, and an L-shaped arm guide member including a forward projecting arm guide element or rod disposed on the outside of the player's arm, and an integral support rod received within the support member for longitudinal and rotary movement, to permit lateral and vertical adjustment of the arm guide element. The arm guide member is adapted to be supported so that its forwardly extending arm guide element may be located outside either of the player's arms, to accommodate a right-handed or left-handed basketball shooter.

10 Claims, 5 Drawing Figures

SHOOTING GUIDE FOR BASKETBALL PLAYER

BACKGROUND OF THE INVENTION

This invention relates to a shooting guide device for a basketball player, and more particularly to a shooting guide device which will restrain the shooter's elbow in a relatively vertical path close to the body.

Shooting guide devices for basketball players are known in the art as shown in the following U.S. patents:

U.S. Pat. No. 3,820,783, Caveness, June 28, 1974

U.S. Pat. No. 4,383,685, Bishop, May 17, 1983

However, the Caveness patent is designed to provide a rather elaborate guide apparatus disposed in front of the basketball player to train the shooter to elevate his shooting arm to a certain height before extending the forearm to shoot the basketball.

The training guide disclosed in the Bishop patent includes a curved guide bar, pivotally mounted upon a vest worn by the player, and an elastic sleeve worn over the elbow of the player and slidably attached to the guide bar so that the shooter's elbow moves in a curved path.

The following U.S. patents disclose arm guides for assisting a bowler in achieving the proper swing for the delivery of a bowling ball:

U.S. Pat. No. 3,000,633, Bonovich, Sep. 19, 1961

U.S. Pat. No. 3,469,841, McKee, Sept. 30, 1969

The following U.S. patents disclose various types of arm guides to assist golf players in developing their golf swing:

U.S. Pat. No. 1,591,523, Fuller, July 6, 1926

U.S. Pat. No. 1,591,524, Fuller, Jul. 6, 1926

U.S. Pat. No. 1,669,457, Dailey, May 15, 1928

U.S. Pat. No. 2,690,911, Newgren, Oct. 5, 1954

U.S. Pat. No. 2,773,691, Redfield, Dec. 11, 1956

However, none of the above patents disclose a guide structure similar to the basketball shooting guide device made in accordance with this invention.

SUMMARY OF THE INVENTION

It is therefore an object of this invention to provide a shooting guide particularly adapted for confining or restraining the elbow of the shooting arm of a basketball player in order to improve his shooting ability.

Another object of this invention is to provide a shooting guide device of simplified construction comprising an L-shaped arm guide member including a forwardly projecting arm guide element and a transversely extending support element or rod adjustably attached to the back of the basketball player.

The L-shaped arm guide member of this invention includes a support rod or element received within a socket member on the back of the player so that the entire arm guide member may be laterally adjusted toward or away from the outside of the shooting arm and pivotally adjusted to various positions in a vertical arc.

Furthermore, the arm guide member made in accordance with this invention is designed to be mounted on either side of the player to accommodate a right-handed or left-handed basketball player.

Another object of this invention is to provide in a basketball shooting guide, a guide element which is secured upon the rear portion of a body harness mounted on the player in order to eliminate any support elements projecting in front of the player, except for the arm guide element.

DESCRIPTION OF THE PREFERRED EMBODIMENTS

Figure 1:
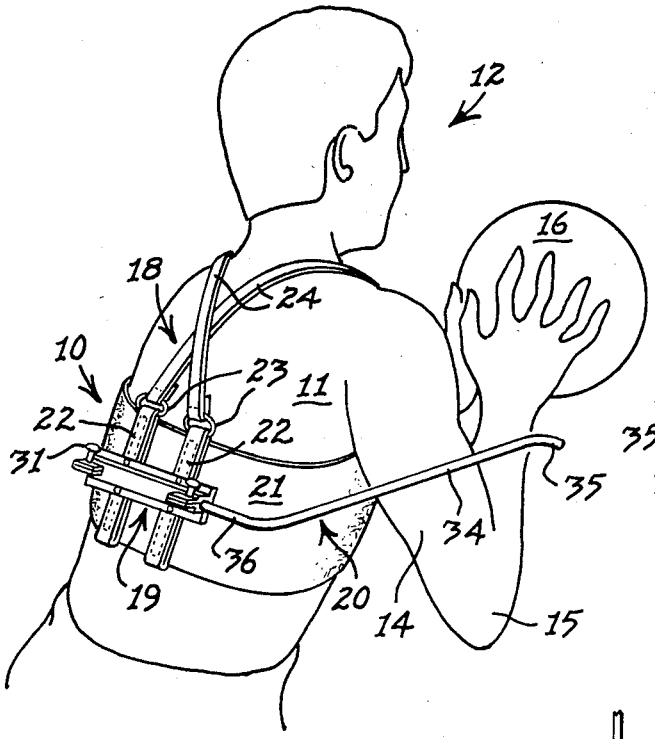
FIG. 1 is a right side, rear perspective view of the shooting guide device, made in accordance with this invention supported in operative position upon a right-handed basketball player in shooting position.
Figure 2:
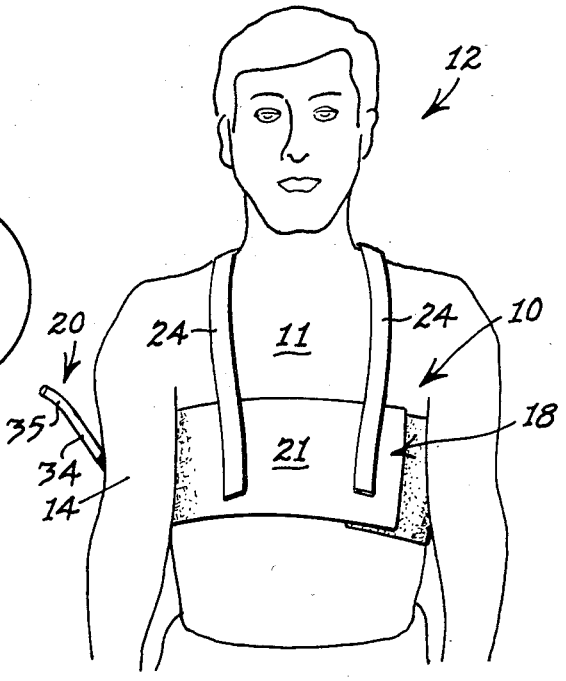
FIG. 2 is a front elevation of the shooting guide device mounted on the basketball player.
Figure 3:
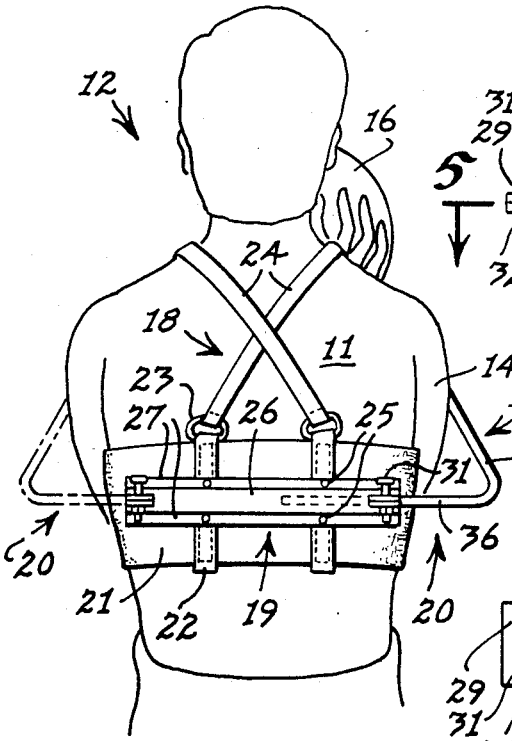
FIG. 3 is a rear elevation of the shooting guide device mounted upon a right-handed basketball player in shooting position, and illustrating the left-hand position of the shooting guide member in phantom.

Referring now to the drawings in more detail, a shooting guide device 10 made in accordance with this invention is illustrated in FIGS. 1, 2 and 3 as being mounted on the torso 11 of a basketball player 12. In the operative position of the guide device 10, the shooting arm 14 of the player (in this case the right arm) is constrained to movement in a substantially vertical path in which the elbow 15 is retained close to the torso 11.

It is known in the art of teaching basketball that more accurate and controlled basketball shooting is attained when the elbow 15 is confined to the proximity of the player's torso 11 as the shooting arm 14 is extended to execute the shot. When the elbow is close to the player's torso 11, a smoother release of the basketball 16, and a recovery of the arm, will be developed. A smoother release will produce a back-spin on the basketball 16, which will improve the accuracy of the shot. The guide device 10 will constantly remind the basketball player 12 to habitually retain his elbow 15 close to his torso 11 during each act of shooting.

The device 10 includes a body harness 18, a support member or socket member 19 and an arm guide member 20.

The body harness 18 may include an elongated, wide, elastic belt member 21, which is adapted to be wrapped around the torso 11 and overlap in the front. The overlapping ends of the belt member 21 may be secured by opposing and cooperating fastener members, such as "Velcro" tapes, not shown.

The belt member 21 is preferably made of elastic material for a comfortable fit, so that the belt member 21 may expand and contract with the breathing and the movements of the player 12.

Secured, such as by stitching, to the rear portion of the belt member 21 are a pair of spaced, vertically extending, reinforcing fabric back pieces 22. The upper ends of the back pieces 22 are connected by respective D-rings 23 to a pair of shoulder straps 24. The shoulder straps 24 extend over opposite shoulders of the player 12 and are secured to the front surface of the belt member 21 by cooperative securing means, such as "Velcro" tape, not shown. The shoulder straps 24 may cross in the back, as shown in FIGS. 1 and 3, or they may extend vertically over the corresponding shoulders without crossing, if desired.

The shoulder straps 24, transmit some of the weight of the device 10 to the shoulders of the wearer, instead of the entire weight of the device being borne by the torso 11 engaging the belt member 21.

Secured to the back pieces 22 by any desired securing means, such as brads 25, is an elongated support member or socket member 26, which extends transversely of the torso 11.

In a preferred form of the invention, the support member 26 is made of a monolithic, slightly elastic, plastic material in the form of an elongated rectangular block having a pair of opposed flanges 27 for receiving the brads 25. Formed longitudinally through the middle of the body portion of the support member 26 is an elongated straight hole 28, extending from one end of the support member 26 to the other, and opening through both ends.

Adjacent each end of the support member 26, are a pair of clamp ears or flanges 29 projecting rearwardly from the body of the support member 26. Elongated slits or slots 30 open into the elongated hole 28 and form an extension of the space between the pairs of flanges 29. A bolt 31 extends vertically through registering holes in the flanges or ears 29. Thus, by tightening the bolt 31, the flanges 29 move together to close the slot 30 and thus tend to reduce the diameter of the portion of the support hole 28. Each bolt 31 may be provided with a nut 32.

Figure 5:
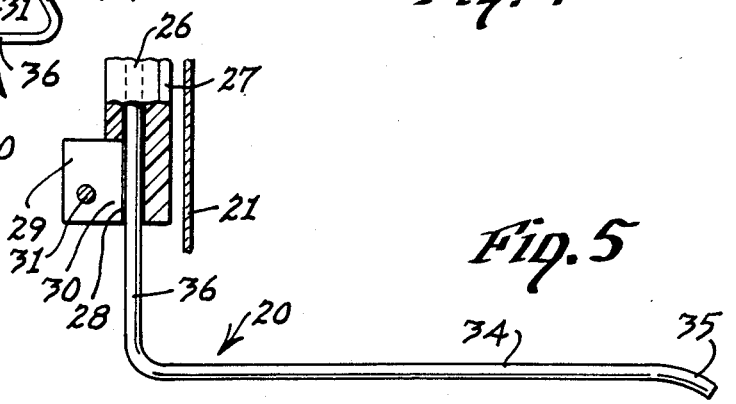
FIG. 5 is an enlarged fragmentary section taken along the line 5—5 of FIG. 4, with the arm guide member in a substantially horizontal position.

The arm guide member 20 itself, is preferably L-shaped, formed by bending or shaping an elongated steel rod approximately ¼" in diameter into the shape disclosed in FIGS. 1, 3 and 5. The arm guide member 20 includes an elongated arm guide element or rod 34 having an outwardly flared front end portion 35 and a rear end portion which is integral with the outside end portion of an elongated support element or rod 36. The elongated support rod 36 is of substantially the same diameter as the hole 28, so that the support rod 36 may be coaxially received within the elongated hole 28 for adjustable, longitudinal, slideable and/or rotary movement about the longitudinal axis of the rod 36.

Although the length of the support rod 36 may vary, it must be long enough to locate the guide element 34 at the desired guiding position outside the shooter's arm 14 and still be securely received within the support hole 28 of the support member or socket member 26. The support rod 36 may rely upon its snug contact with the surface of the hole 28 for support and/or the squeezing of the rod 36 by the contraction of the hole 28 by virtue of tightening the clamp bolt 31.

The length of the guide rod 34 is great enough that it will extend from its juncture with the support rod 36 behind the back of the player 12 to a forward position far enough in front of the player 12 that the guide rod 34 will constrain the shooting arm 14 of the player 12 over its initial path of movement.

The flared position 35 is to eliminate injury to the shooting arm 14 after the basketball 16 has been shot and as the arm 14 returns to its normal depending position between the torso 11 and the guide arm 34.

The arm guide member 20 may be shifted laterally, either inward or outward, by loosening the clamp bolt 31 and slipping the support rod 36 farther into, or away from, the hole 28 in the support member or socket member 26. Such lateral adjustment of the arm member 20 may be necessary to accommodate shooting arms 14 of different sizes. Moreover, the lateral adjustment may be desired in order to permit more latitude of the location of the elbow 15 during the initial shooting exercises. Then as the player 12 becomes more proficient, the arm member 20 may be shifted laterally inward in order to further confine the arm 14 and draw the elbow 15 closer to the torso 11 as each shot is executed.

Figure 4:
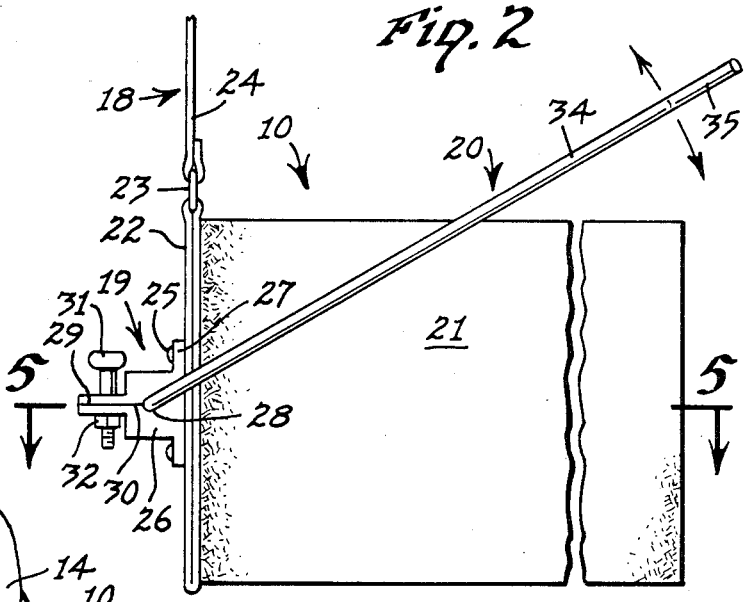
FIG. 4 is an enlarged fragmentary right side elevation of the device, with the arm guide element in a raised position.

In order to adjust the arm guide element 34 to different elevations in order to accommodate players 12 of different sizes, or to accommodate the feel of the shot, the clamp bolt 31 may be released and the arm member 20 rotated about the longitudinal axis of the support rod 36 to pivot the guide element 34 in a substantially vertical plane, as illustrated in FIG. 4.

In the preferred form of the invention, the guide rod 34 is disposed at substantially a right angle to the support rod 36, so that when the support rod 36 is in a substantially horizontal transverse position, the movement of the guide arm 34 will be in a substantially vertical plane in order to guide the shooting arm 14 in a substantially vertical plane next to the player's body.

As shown in the drawings, the guide rod 34 is designed to guide the upper arm portion of the player 12, as opposed to the forearm. By controlling the upper arm, between the shoulder and the elbow, the elbow 15 will be constrained to movement in a substantially vertical plane and thereby remain under the basketball 16 during the execution of the shot.

As illustrated in FIG. 3, the arm guide member 20, without any change in construction, may be inserted on the left side of the player 12 by insertion of the support rod 36 into the opposite end of the hole 28 in the socket member 26. The left-hand position of the arm member 20 is disclosed in phantom in FIG. 3.

Because of the minimum number of parts and the minimum weight and size of the parts, particularly if the arm guide member 20 and the socket member 26 are made of plastic and the harness 18 is made mostly of textile fabric, the total weight of the device 10 can be approximately 1 lb., and thereby increase the comfort and decrease the fatigue of the player 12 wearing the device 10. Moreover, because the materials incorporated in the device 10 are lightweight and also relatively soft, when made of fabric and plastic, the player 12 is not likely to be injured by the device 10 in the event that he uses it incorrectly.

What is claimed is:

1. A shooting guide device for a basketball player comprising:

(a) a body harness, including a back piece, adapted to fit and be secured about the torso of a basketball player, (b) an L-shaped arm guide member comprising an elongated arm guide element having a front end portion and a rear end portion, and an elongated support element having a first end portion and a second end portion, said first end portion being integral with said rear end portion, (c) a support member fixed to said back piece, and (d) said support member comprising socket means for receiving said support element for longitudinal movement laterally of the torso of the player, and for rotary movement about the longitudinal axis of said support element, whereby said arm guide element may be located outside and adjacent the shooting arm of the player in various laterally and vertically adjusted operative positions.

2. The invention according to claim 1 in which said elongated arm guide element is at substantially a right angle to said elongated support element.

3. The invention according to claim 2 in which said socket means comprises an elongated straight hole in said support member for receiving said elongated support member for longitudinal and rotary reciprocable movements, and means for securing said support element in various adjusted positions within said socket means.

4. The invention according to claim 3 in which said elongated hole is disposed transversely of the torso upon which said body harness is fitted, and said hole is substantially horizontal when the basketball player is standing in a shooting position.

5. The invention according to claim 4 in which said securing means comprises clamp means with adjustable screw means for opening and closing said clamp means.

6. The invenion according to claim 4 in which said elongated hole extends transversely through said socket member and opens at opposite ends of said socket member, whereby said second end portion of said support element may be inserted into either end of said support member for locating said arm guide element on the outside of either arm of the basketball player.

7. The invention according to claim 3 in which said socket means is made of an elastic material, said elongated hole opening rearwardly and defining opposed clamp walls, and clamp means secured to said clamp walls for moving said clamp walls toward and away from each other to thereby reduce and enlarge the size of said hole for selectively securing and releasing said support element in said hole.

8. The invention according to claim 2 in which said front end portion of said arm guide element diverges outwardly from the torso of the player.

9. The invention according to claim 1 in which said body harness comprises an elongated flexible belt member adapted to encircle the torso of the player, said back piece comprising the back portion of said belt member.

10. The invention according to claim 9 in which said body harness further comprises shoulder straps secured to said belt member to fit over the shoulders of the player in operative position.

* * * * *